US010257912B2

(12) United States Patent
Mayrhofer et al.

(10) Patent No.: US 10,257,912 B2
(45) Date of Patent: Apr. 9, 2019

(54) BALLAST FOR LUMINOUS MEANS HAVING A MICROPROCESSOR AND A PROGRAMMING INTERFACE

(71) Applicant: TRIDONIC GMBH & CO KG, Dornbirn (AT)

(72) Inventors: Markus Mayrhofer, Dornbirn (AT); Frank Lochmann, Esseratsweiler (DE); Florian Moosmann, Muntlix (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 15/768,907

(22) PCT Filed: Nov. 17, 2016

(86) PCT No.: PCT/EP2016/077994

§ 371 (c)(1),
(2) Date: Apr. 17, 2018

(87) PCT Pub. No.: WO2017/085182

PCT Pub. Date: May 26, 2017

(65) Prior Publication Data

US 2018/0270932 A1 Sep. 20, 2018

(30) Foreign Application Priority Data

Nov. 17, 2015 (DE) ..... 20 2015 106 224 U

(51) Int. Cl.
*H05B 37/02* (2006.01)

(52) U.S. Cl.
CPC ..... *H05B 37/0245* (2013.01); *H05B 37/02* (2013.01)

(58) Field of Classification Search
CPC ..... H05B 37/0218; H05B 37/0245; H05B 37/0254; H05B 37/0281; H05B 37/0272; H05B 37/0227
(Continued)

(56) References Cited

U.S. PATENT DOCUMENTS

2005/0179404 A1 8/2005 Veskovic et al.
2007/0268151 A1 11/2007 Reinhold et al.
(Continued)

FOREIGN PATENT DOCUMENTS

CN 103870403 6/2014
DE 102004061294 6/2006
(Continued)

OTHER PUBLICATIONS

German search report in priority German Patent Application DE 20 2015 106 224.9 dated Aug. 4, 2016.
(Continued)

*Primary Examiner* — Douglas W Owens
*Assistant Examiner* — Syed M Kaiser
(74) *Attorney, Agent, or Firm* — Andrus Intellectual Property Law

(57) ABSTRACT

Ballast for luminous means, in particular LEDs, having a microprocessor with at least one memory unit and a printed circuit board, having at least one programming interface which is preferably accessible from outside the ballast and at least one signaling interface which is likewise preferably accessible from outside the ballast, wherein the microprocessor can be configured via the programming interface, and wherein at least one item of application software which can be executed by the microprocessor can be transmitted to the at least one memory unit via the programming interface, wherein the application software influences at least one of the following functionalities of the ballast: interaction with
(Continued)

sensors, evaluation of signals transmitted to the signaling interface, control of the luminous means, activation/deactivation of interfaces of the ballast, activation/deactivation of communication protocols, acquisition, setting and/or evaluation of operating data and/or operating parameters of the ballast, setting-up of a network and linking of networks.

20 Claims, 3 Drawing Sheets

(58) Field of Classification Search
USPC ..... 315/291, 294, 307, 122, 192, 224
See application file for complete search history.

(56) References Cited

U.S. PATENT DOCUMENTS

2010/0295474 A1* 11/2010 Chemel ..... H05B 37/0272 315/294
2010/0327766 A1* 12/2010 Recker ..... H02J 7/025 315/291
2012/0043889 A1* 2/2012 Recker ..... H05B 33/0815 315/86
2012/0080944 A1* 4/2012 Recker ..... H02J 9/02 307/25
2012/0086345 A1* 4/2012 Tran ..... H05B 33/0845 315/158
2013/0057158 A1* 3/2013 Josefowicz ..... G01S 19/14 315/152
2013/0320874 A1 12/2013 Dobler
2014/0327364 A1 11/2014 Bischof et al.
2015/0022114 A1* 1/2015 Kim ..... H05B 33/0803 315/294
2015/0257229 A1* 9/2015 Wassel ..... H05B 37/02 315/307
2015/0264779 A1* 9/2015 Olsen ..... F21S 8/026 315/294
2016/0327255 A1* 11/2016 Wittmann ..... H05B 33/08

FOREIGN PATENT DOCUMENTS

DE 102008053486 5/2010
DE 102009032026 1/2011
DE 102010025082 12/2011
DE 102011086702 5/2013
DE 102012011049 12/2013
DE 102014200297 7/2015
EP 1954105 8/2008
WO 2015025267 2/2015
WO 2015104279 7/2016

OTHER PUBLICATIONS

PCT search report in parent PCT Application PCT/EP2016/077994 dated Jan. 23, 2017.

* cited by examiner

BALLAST FOR LUMINOUS MEANS HAVING A MICROPROCESSOR AND A PROGRAMMING INTERFACE

CROSS REFERENCE TO RELATED APPLICATIONS

The present application is the U.S. national stage application of International Application PCT/EP2016/077994, filed Nov. 17, 2016, which international application was published on May 26, 2017 as International Publication WO 2017/085182 A1. The International Application claims priority to German Patent Application 20 2015 106 224.9, filed Nov. 17, 2015.

FIELD OF THE INVENTION

The invention relates to ballast for at least one lamp, in particular an LED, that can be largely and substantially freely configured by a user.

For this, the ballast has a programmable microprocessor with relatively high processing power, and can communicate in different ways, i.e. using numerous interfaces. A DALI, SPI, DSI, WLAN, Bluetooth, LAN, and/or USB interface may be provided for this.

Sensors as well as signal transmitters can be connected to the ballast, and the microprocessor is connected to the interfaces, in order to evaluate both sensor signals as well as signals from signal transmitters, for example. The microprocessor can then modify operating properties of the ballast on the basis of incoming signals from sensors and/or signal transmitters, or signals received via the interfaces, and thus affect the light emission or other functions of the ballast. It is possible to communicate with external communication partners by means of LAN, Bluetooth, USB, DALI, WLAN, . . . , for example.

BACKGROUND OF THE INVENTION

In particular, the ballast has a programming interface, via which an application software can be transmitted to a memory unit provided in the ballast. This comprises an executable software and/or software component that can be executed by the microprocessor, which is part of a firmware and/or the operating system, or which can be executed by these. The application software is then executed by the microprocessor. The operating system manages a memory space in particular, which can be subdivided into a user space ("user space") and an operating system core space ("kernel space"). This subdivision makes it possible to protect parts of the memory space. The operating system core space is then reserved for executing the operating system core, while the user space is provided for executing application software and/or drivers for interfaces and/or devices connected to the microprocessor. The memory space can be part of a memory provided by the memory unit.

A user can influence and determine the manner in which the ballast behaves, or how the signals from sensors or signal transmitters are evaluated and used for activating the at least one lamp, by transmitting the application software to the memory of the ballast, and preferably the user space. It is also possible to configure how an evaluation for activating components connected to the ballast via the interfaces is processed. In particular, the evaluation and processing of input signals can be configured or modified by means of the application software, such that a lighting control can be defined on the basis of the received signals.

SUMMARY OF THE INVENTION

The invention thus provides a ballast and a lamp according to the independent claims. Further developments of the invention are the subject matter of the dependent claims.

In a first aspect, a ballast for lamps is provided, in particular LEDs, which has a microprocessor with at least one memory unit, and a printed circuit board with at least one edge, to which at least one programming interface that can be accessed from outside the ballast, and at least one signaling interface, which preferably can also be accessed from outside the ballast, are attached, wherein the microprocessor can be configured via the programming interface, and wherein at least one application software that can be executed by the microprocessor can be transmitted to the at least one memory unit, wherein the application software influences at least one of the following functions of the ballast: interaction with sensors, evaluation of signals transmitted to the signaling interface, activation of the lamp, activation/deactivation of interfaces of the ballast, activation/deactivation of communication protocols, operating parameters of the ballast, the structure of a network, and linking to networks.

The at least one application software can provide, make available, and/or modify an application programming interface.

The microprocessor can execute a hardware abstraction subsystem, via which the at least one application software accesses the programming interface and/or the signaling interface.

The programming interface can be a wireless and/or wire-connected interface, in particular a Bluetooth, WLAN, LAN, GPIO, and/or Zigbee interface. The signaling interface can be used for connecting at least one signaling unit, e.g. a switch, a button, a timer switch, a remote control, an active or passive sensor, e.g. presence detector, a brightness sensor, a humidity sensor, a temperature sensor, and/or a microphone.

The signaling interface can be configured as a USB, DALI, DSI, SPI and/or $I^2C$ interface. The signaling interface can be configured as a modified $I^2C$ interface.

The ballast can be configured to activate the lamp, in particular the LED, preferably depending on a functionality defined by the application software.

The programming interface can be blocked, and can be activated by inputting and/or transmission of a code. The programming interface can be blocked, for example, by an encryption or password.

The programming interface and the signaling interface can use the same hardware, and only be separate in terms of software. The programming interface can use the signaling interface for data communication.

The ballast can communicate with other ballasts and/or at least one converter via at least one interface, in particular in a wireless and/or wire-connected manner, e.g. by means of a bus (DALI bus) and/or via radio transmission.

The application software can block and/or enable at least one function provided by the programming interface, the signaling interface, and/or the application programming interface.

All of the interfaces can be disposed on the at least one edge of the printed circuit board.

The microprocessor can be a single chip system.

In another aspect, a sensor is provided for a lighting system that has a microprocessor with at least one memory unit and preferably a printed circuit board that has a programming interface that is preferably accessible from outside the sensor, and at least one signaling interface that is also preferably accessible from outside the sensor, attached to it, wherein the microprocessor can be configured via the programming interface, and wherein at least one application software that can be executed by the microprocessor can be transmitted to the at least one memory unit via the programming interface, wherein the application software affects at least one of the following functions of the sensor: interaction with other sensors and components, in particular ballasts, the lighting system, evaluation of signals transmitted to the signaling interface, activation of one or more ballasts, activation/deactivation of interfaces of the sensor, activation/deactivation of communication protocols, and detection, adjustment and/or evaluation of operating data and/or operating parameters of the sensor (IS) and/or the other sensors, the structure of a network, and linking of networks.

The programming interfaces and the signaling interfaces can use the same hardware, and only be separate in terms of software. The programming interfaces can use the signaling interfaces for data communication.

In yet another aspect, a lighting system or a lamp with a ballast, as described above, and/or a sensor, as described above, are provided.

BRIEF DESCRIPTION OF THE DRAWINGS

The invention shall now be described in reference to the drawings. Therein.

DETAILED DESCRIPTION

Figure 1:
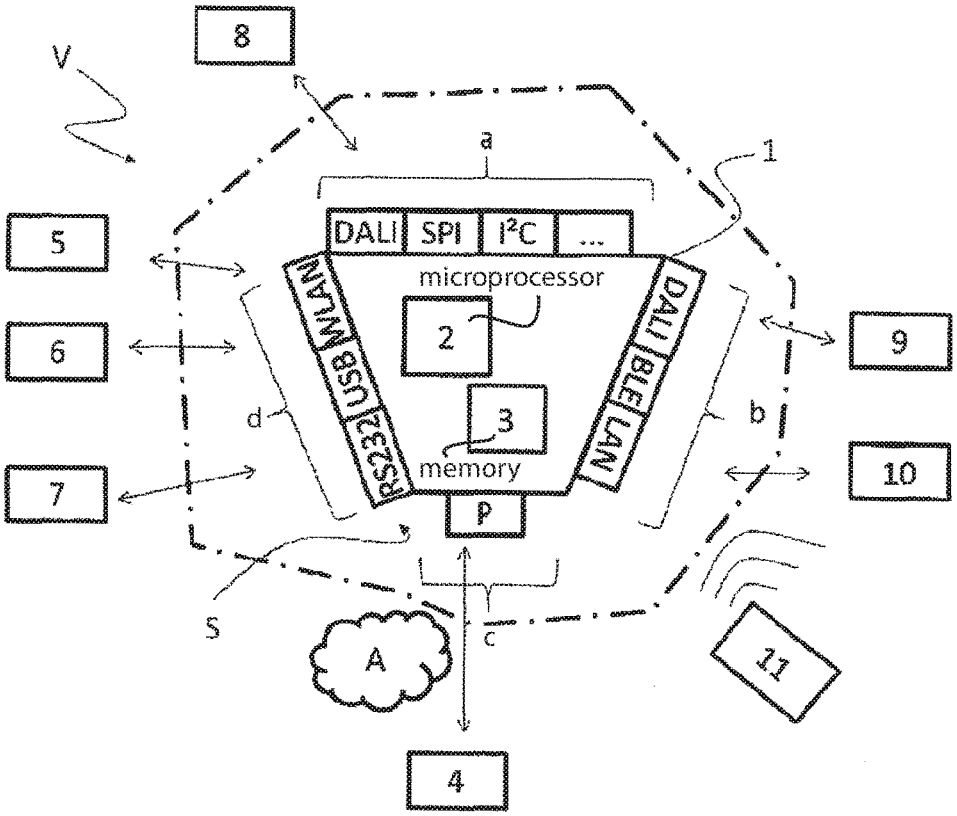
FIG. 1 shows a schematic overview of the invention.

A microprocessor 2 is provided in the ballast V, which is connected to at least one memory unit 3, such that it can access the memory unit 3, and read data therefrom, as well as write data therein.

The microprocessor 2 (e.g. ARM Cortex-A5x, ARM Cortex-A7x, . . . ) is preferably located on a printed circuit board 1, which preferably has at least one edge, and to which the memory unit 3 can also be attached. The microprocessor 2 and/or the memory unit 3 can also be placed on a separate printed circuit board that is connected to the printed circuit board 1, e.g. by means of a plug-in connection. The printed circuit board has a programming interface P and at least one signaling interface S on the at least one edge, which can also be attached to the at least one edge of the printed circuit board, or can also be attached to another edge of the printed circuit board.

At least the programming interface P is accessible from outside the ballast. The programming interface can be configured for a wireless and/or wire-connected communication. In particular, the programming interface P can be a wireless interface (Bluetooth, WLAN, Zigbee, RFID, . . . ) and/or a wire-connected interface (parallel, RS323, USB, JTAG, GPIO, . . . ). It is thus not always necessary for the programming interface P to be exposed to the exterior. Instead, it is also possible to access the programming interface P inductively from the exterior, in order to transfer data, for example, from a programming device 4 to the memory unit 3 and/or the microprocessor 2, by means of the programming interface P. In this manner, it is ensured that the ballast V can be appropriately designed for an operating site, and can have a required type of protection (International Protection Code (IP) certification).

As a matter of course, the programming interface P can also be exposed. This allows for a wired connection to the programming interface P. A programming device 4 can thus be connected to the programming interface P by a cable, and data transfer to or from the memory unit 3 and/or the microprocessor 2 can take place.

The microprocessor 2 or its data processing unit can be configured with data transmitted via the programming interface P that can then be stored in the memory unit 3. In particular, an application software A (also referred to as an "app") can be transmitted to the memory unit. This application software A is then executed by the microprocessor 2, wherein it is understood that the microprocessor 2 can also execute numerous application software components.

The programming interface P and the signaling interface S can also use the same hardware, for example, and only be separate in terms of software.

The application software A stored in the memory unit 3 that is executed by the microprocessor 2 can then affect one of the following functions of the ballast V:

By way of example, the interaction or evaluation of sensor data delivered by the sensors interacting with the ballast can be defined or modified. In particular, the sensors can send signals to the ballast via the signaling interface S. These signals are then evaluated by the at least one application software A, and processed in accordance with a definition provided by the application software A.

Instead of sensors, other signal transmitters such as switches, buttons, or control input devices (also referred to in general as "controls" in the field of the invention) can also deliver signals to the ballast V via the signaling interface S, as described above in reference to the signals delivered by the sensors, and then evaluated and processed in accordance with the requirements defined by the at least one application software.

The application software A can also define how the ballast V interacts with the signal sources (sensors, signal transmitters, . . . ) connected thereto. In particular, it is possible to establish which signals are evaluated or processed, and which type of signal transmitter the ballast V works with. It is possible to define in this manner which signal sources provide signals that can be evaluated. Signal sources or interfaces can also be blocked or made accessible, and it is possible, for example, to thus expand or delimit the scope of functions of the ballast V.

The at least one application software A can also have an effect on the control, by means of which the ballast V activates the at least one lamp, for example. As a result, the lamp can be activated by the application software A, in particular depending on the incoming signals from the signal sources. Here as well, the behavior of the lamp and/or devices attached thereto can be modified by transmitting a new application software A thereto. An application software A stored in the memory unit 3 of the ballast V can also modify the evaluation of the signals, as a matter of course.

A further function of the application software A is that the functions provided by the ballast V can also be modified, and in particular, interfaces can be activated or deactivated. The scope of functions of the ballast V can also be controlled in this manner. Communication protocols provided for the communication of the ballast with other components, e.g.

other ballasts, operating devices, or control centers, can likewise be activated or deactivated. The ballast V can thus be adapted to different uses, in that only individual communication protocols can be accessed, for example. On the other hand, the functionality of the ballast V can also be expanded, if additional communication protocols need to be added or deactivated. This may be the case, for example, if the ballast is used for something else. On the whole, the application software, the operating data and/or the operating parameters can detect, determine, evaluate and modify the ballast V.

It is understood that the at least one application software A can also be updated and modified in the memory unit 3. This can likewise take place via the programming interface P. It is also possible for more than one application software A to be stored in the memory unit 3 and executed by the microprocessor. Additional features of the ballast V can thus be activated or deactivated by adding an application software A. By way of example, one application may only provide a base function, while another application software A deactivates or activates additional functions of the ballast V.

The application software A can also provide, make available, or modify an application programming interface. This application programming interface can then be used for adding further software components of the application software that likewise relate to functions of the ballast, in particular for activating or deactivating functions.

The microprocessor 2 preferably executes a hardware abstraction subsystem (HAL, Hardware Abstraction Layer). The application software then preferably accesses the programming interface and/or the signaling interface via the hardware abstraction layer. The programming interface can be a wireless and/or a wire-connected interface.

The signaling interface S can likewise be a DALI, DSI, SPI and/or $I^2C$ interface.

The programming interface P can be configured such that a programming or application software transmission is initially not possible. An initially blocked programming interface of this type may require that a code or an activation key, e.g. a cryptographic key, must first be transmitted to ballast in order to activate the programming interface P. In particular, the programming interface P can then only be activated (e.g. for a predetermined period) when a corresponding activation of the programming interface P has taken place. By way of example, an encrypted application software transfer can take place via the programming interface, wherein the ballast has access to a first code or activation key stored in the ballast, e.g. a cryptographic key. By way of example, this first code or activation key, e.g. a cryptographic key, is a public key that can be used to decode the application software transmitted to the programming interface. This first code or activation key, e.g. a cryptographic key, can preferably only decode, but not encode. The programming device may have a second code or activation key, e.g. a cryptographic key, that is a type of private key, which can preferably be used both for encryption as well as decryption. In this manner, the programming device can enable an encrypted application software transfer via the programming interface, wherein the ballast can receive and read this encrypted application software.

Furthermore, the programming interface P can only then be activated when a programming device 4 is located within a certain distance to the programming interface P, or is connected to the programming interface P. The programming device 4 can then automatically transmit an ID or a key via the programming interface P to the microprocessor 2, which is then recognized by the microprocessor (e.g. by means of NFC). The microprocessor 2 can then transfer data to the memory unit 3, thus enabling an activation of the programming interface P.

The ballast V can have other wire-connected and/or wireless communication interfaces, in order to communicate, for example, with other ballasts or operating devices. These communication interfaces are attached to an edge of the printed circuit board, for example. The ballast V can likewise have a converter interface, via which one or more ballasts or converters can be connected to the ballast. The application software A, or the microprocessor 2 can thus control one or more further ballasts or converters connected to the ballast V. The microprocessor 2 is a single chip system (System on a Chip, SoC), in particular. The interfaces available in the ballast are all attached to at least one edge of the printed circuit board 1, for example.

The printed circuit board 1 a substantially polygonal shape. Alternatively, it could also be round or oval. By way of example, the printed circuit board can be substantially rectangular, triangular, or trapezoidal, and the interfaces can be disposed along the edges of the printer circuit board 1. The microprocessor 2, together with the memory unit 3, can be connected wirelessly or by means of cable to the printed circuit board.

A purely exemplary illustration thereof is shown in FIG. 1. FIG. 1 shows a printed circuit board 1 of a ballast V, on which a microprocessor 2 and a memory unit 3 are disposed. The exemplary, substantially trapezoidal design of the printed circuit board 1 has four edges, indicated with a, b, c, and d. Various interfaces can then be attached to the edges a, b, c, d of the printed circuit board 1, which can also be assigned to various functional groups. The interfaces on a first edge can thus be configured, for example, for communication with other ballasts (converters) or other components in a lighting system. Interfaces are shown, for example, on the first edge a, which are configured, e.g. as communication interfaces for communication by means of DALI, SPI, and/or $I^2C$ (Inter-Integrated Circuit) busses/protocols. Interfaces for communication with control units ("controls") can then be provided on a second edge b. By way of example, a DALI, Bluetooth (Bluetooth Low Energy, BLE) and a LAN interface are shown on the second edge. An interface P is provided on a third edge c.

The interface P is preferably a programming interface. This can be protected against access, or selectively activatable, through mechanical or software measures. A programming device 4 is also shown by way of example, from which at least one application software A can be transmitted to and/or from the interface P, which can likewise be a Bluetooth (e.g. BLE) interface.

Lastly, interfaces are provided on a fourth edge d, which are used, e.g. for connecting sensors and/or other hardware that are to be connected to the ballast. By way of example, a WLAN (or WiFi), a USB, and a serial RS232 interface are shown. These can enable communication with a microphone assembly 5, a humidity sensor 6 and/or a presence sensor 7. The sensors can be active or passive.

The programming interface P and the signaling interface S can use the same hardware, for example, and only be separate in terms of software. The signaling interface S can be used for encrypted transmission of application software A, wherein this encrypted transmission forms the programming interface P in this case. The signaling interface S thus provides an encrypted transmission of the application software A while simultaneously forming the programming interface P. The signaling interface S and the programming interface P use the same infrastructure in this case, but are separate in terms of software. The programming interface P can use the signaling interface S for data transfer, in particular for the application software A transmission.

The ballast V can have a first code or activation key, e.g. a cryptographic key, which is stored in the ballast V. By way of example, this first code or activation key, e.g. a cryptographic key, is a public key, which can be used to encrypt the application software A transmitted to the programming interface P. This first code or activation key, e.g. a cryptographic key, only enables decryption, but not encryption. The programming device can have a second code or activation key, e.g. a cryptographic key, that is a type of private key, which can preferably be used for both encryption and decryption. In this manner, the programming device can enable an encrypted application software A transmission via the programming interface P, wherein the ballast can receive and read this encrypted application software.

The application software A can be transmitted via the programming interface P in individual packets. By way of example, these packets can each have a port address. The packets, together with the port addresses can be received by the ballast V and assigned to the appropriate port within the ballast. The individual packets can be transmitted in an encrypted form via the programming interface P. The ballast V can receive the encrypted packets, and assign them to the appropriate ports on the basis of their port addresses.

A further ballast (also referred to as a converter), or at least another component of a lighting system 8, is also shown in FIG. 1, which can be connected to one of the interfaces on the first edge a for communication. In this regard, the interfaces on the edge a can also be referred to as converter interfaces. A coupling element 9, for example, (e.g. a switch or router) can be connected to the interfaces on the second edge b, via which the ballast can be connected to other components/ballasts. A timer switch 10 or clock timer can also be connected to one of the interfaces on the second edge b. Furthermore, it is also possible to communicate with a remote control 11 via radio transmission or infrared and corresponding interfaces. Moreover, the signaling interface is indicated by way of example with S. In theory, each interface differing from the programming interface is to be regarded as a signaling interface S.

It is understood that the printed circuit board 1 does not have to be a regular geometric body. The interfaces disposed on the at least one edge can also be arranged on top of one another in the shape of a pyramid. In particular, an interface disposed above/below another interface can be displaced slightly toward the interior of the printed circuit board 1. The programming interface can be protected against misuse in that it is a separate hardware and/or is cryptographically protected.

The signaling interface S can be used for connecting switches, timer switches, remote controls, etc. A separate interface can be provided for other signal transmitters, e.g. sensors, (movement sensors, brightness sensors, humidity sensors, microphones, presence sensors, . . . ). The signals thereof can also be sent to the signaling interface.

The signaling interface S, and optionally other interfaces, are preferably a USB interface, $I^2C$ interface, or a DALI interface. The microprocessor 2 can have microprocessor interfaces appropriate for connecting the interfaces. The processing by the microprocessor 2 can be configured, as described above, via the application software A, and this can thus modify the ballast V, and in particular a lighting system or the functioning thereof. It is thus possible for a user to create an application software A, which then specifically enables the functions of the ballast V. Using the hardware abstraction layer, the at least one application software A can then be used for implementing the interfaces that are used, and for configuration. The microprocessor can be connected, for example, to another ballast or converter via a fourth interface. This interface can be configured as a DALI, SPI, or $I^2C$ interface. Alternatively, the microprocessor can also be integrated in the other ballast or converter.

Aside from the possibilities for communication mentioned above, other communication paths are also possible, e.g. via the signaling of the light emitted by the lamp, or through communication by means of PLC (Power Line Communication).

As explained above, the ballast V can have just one single hardware signaling interface S, which at the same time forms other software interfaces. The programming device 4, a microphone assembly 5, a humidity sensor 6, and/or a presence sensor 7 can be connected to the signaling interface S. Additionally or alternatively, other components T, such as other ballasts of a lighting system, can be connected to the signaling interface S, for example. Furthermore, additionally or alternatively, a coupling element 9 can be connected to the signaling interface S. Additionally or alternatively, a timer switch 10, or clock timer, and/or a remote control 11 can also be connected to the signaling interface S. As explained above, the signaling interface S can simultaneously form the programming interface P.

It would also be possible for there to be at least one further hardware interface in addition to the signaling interface S, in order to connect further components that cannot communicate in accordance with a protocol of the signaling interface S. By way of example, the signaling interface S can be formed by a LAN interface or a WLAN interface, which simultaneously forms the programming interface P. In addition, the ballast V can also have an $I^2C$ interface, in order to forward, for example, the data transmitted via the LAN interface or WLAN interface to further components connected to the $I^2C$ interface, e.g. other ballasts and/or sensors. It would be possible for both the LAN interface or WLAN interface, as well as the $I^2C$ interface to form the signaling interface S, which simultaneously forms the programming interface P. Thus, data received from the ballast V by means of the LAN interface or the WLAN interface, e.g. an application software A transmitted thereto, can be forwarded on the $I^2C$ interface to other components connected thereto. Additionally or alternatively, the ballast V can also have a DALI interface, in order to communicate, for example, with DALI sensors and/or DALI ballasts connected thereto.

By way of example, it would also be possible for the ballast V to have a signaling interface S, and at least one other hardware interface for connecting further components that cannot communicate in accordance with a protocol of the signaling interface S. By way of example, the signaling interface S can be formed by a LAN interface or a WLAN interface, which simultaneously forms the programming interface P. Additionally, the ballast V can have a DALI interface, in order to communicate, for example, with DALI sensors and/or DALI ballasts connected thereto.

Figure 2:
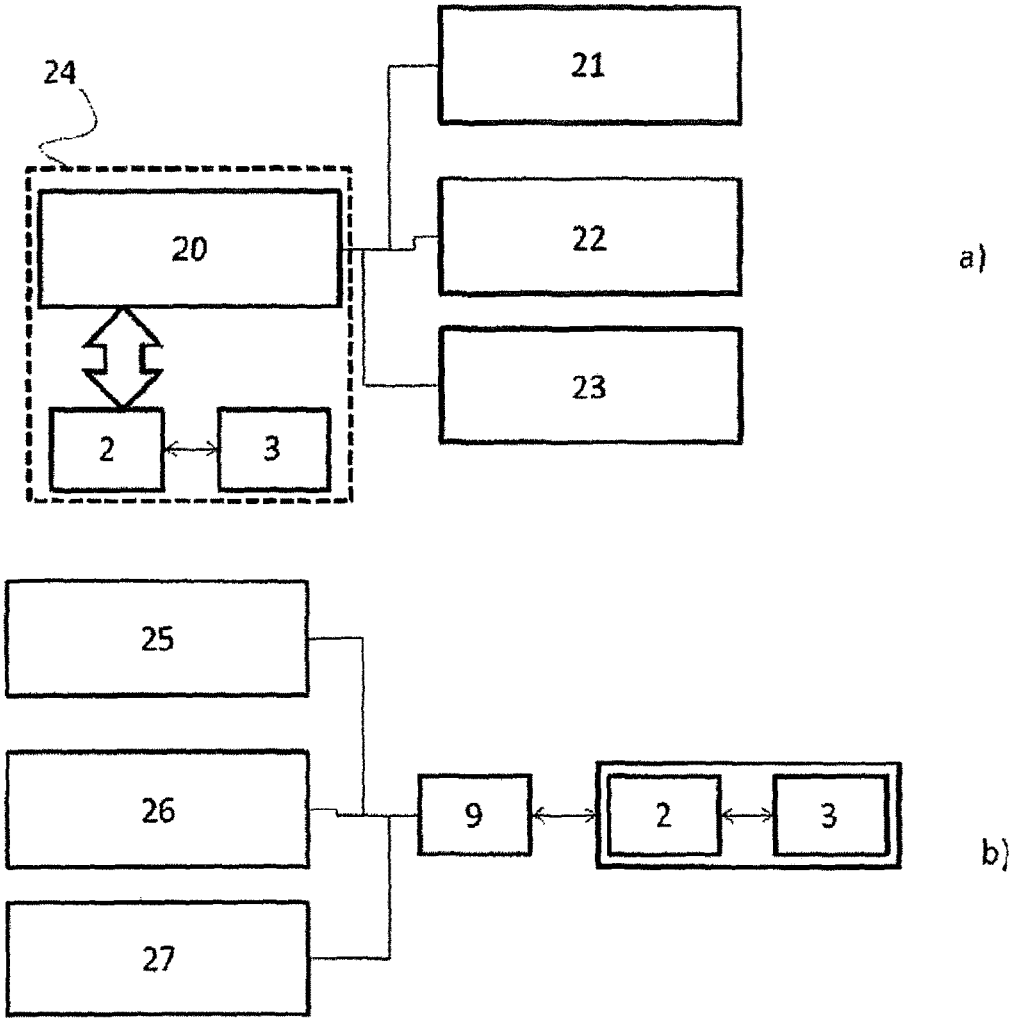
FIG. 2 shows exemplary arrangements.

FIG. 2 shows one exemplary possibility in which the microprocessor 2 communicates with one or more ballasts 20, 21, 22, 23. In FIG. 2*a*) a lamp 24 with a ballast 20 is shown, which has the microprocessor 2 and the memory unit 3. The ballast 20 corresponds in this example to the ballast V in FIG. 1, or the other examples. The memory unit 3 can be integrated in the microprocessor 2. The microprocessor 2 and the memory unit 3 are preferably disposed in the ballast 20. It would also be possible, however, for the microprocessor 2 and the memory unit 3 to be disposed outside the ballast 20, but inside the lamp 24. There is at least one connection of the microprocessor 2 to the ballast 20. Other ballasts (converters) 21, 22, 23 of lamps (not shown) are likewise shown, each of which has only one converter, but not a microprocessor. The communication of the various ballasts or converters can then take place, for example, via a DALI bus or an $I^2C$ bus. Only one of the lamps, or one of the ballasts, however, can be expanded via the application software A. The application software A, however, can likewise determine the activation of the other ballasts (converters), such that, depending on the configuration of the ballast (converter) 20 by the application software A, a situation- and application site-appropriate configuration, or such an operation thereof, can take place.

In an alternative example, at least numerous ballasts can each have a microprocessor and a memory unit. In this case, the numerous ballasts can be connected via a signaling interface S, which can simultaneously form the programming interface P, such that the application software can be transmitted to numerous ballasts.

As is shown in FIG. 2*b*), the microprocessor 2 does not necessarily have to be accommodated in a lamp or in a ballast, but instead, an external microprocessor can be provided. The microprocessor can be connected by means of the coupling element 9 to numerous stations, and in particular to numerous ballasts, converters, or lamps 25, 26, 27 in a network, wherein the coupling element 9 can be a gateway with LAN interfaces, a WLAN router, or a DALI bus master, for example, to which numerous ballast, converters, or lamps 25, 26, 27 can be connected. The communication to the ballast, converters, or lamps 25, 26, 27 can than take place digitally via the connection provided there, e.g. by means of an $I^2C$, DALI, or DSI protocol. As a matter of course, a microprocessor can also be provided in each ballast or in each lamp.

It would also be possible for the coupling element 9 to be configured such that it has a LAN interface or a WLAN interface. This LAN interface or WLAN interface can form the signaling interface S. Additionally, the coupling element 9 can also have an $I^2C$ interface, in order to forward the data transmitted via the LAN interface or the WLAN interface to further components connected to the $I^2C$ interface, e.g. a ballast V or ballast 20, and/or sensors. It would be possible for both the LAN interface or WLAN interface, as well as the $I^2C$ interface, to form the signaling interface S, which simultaneously forms the programming interface P. Thus, data received from the coupling element 9 by means of the LAN interface or the WLAN interface, e.g. an application software A transmitted thereto, is to be forwarded via the $I^2C$ interface to the ballast V or ballast 20 connected there. In this manner, it would be possible to form a signaling interface S and, simultaneously, a programming interface P, such that an application software A that can be configured via the programming interface P can be executed on the ballast V or 20. Additionally or alternatively, the coupling element 9 can also be configured for executing the application software A. Additionally or alternatively, the coupling element 9 can also have a DALI interface, in order to communicate with DALI sensors and/or DALI ballasts connected thereto.

The application software A can be transmitted in individual packets via the programming interface P, as has already been explained in reference to the various exemplary embodiments. By way of example, these packets can each be provided with a port address. The packets with the port addresses can be received by the microprocessor 2 of the ballast 20, and assigned to the corresponding port in the memory 3. The individual packets can be transmitted in the encrypted form via the programming interface P. The microprocessor 2 of the ballast 20 can receive the encrypted packets and assign them to the appropriate ports in the memory unit 3 according to their port addresses.

By way of example, operating data can be acquired, adjusted and/or evaluated, and/or operating parameters can be acquired, adjusted and/or evaluated and established in the ballast V or 20 by the application software A, which establish or define a dimming/lighting level for a space and/or a maximum/minimum operating temperature, when an incoming signal is evaluated as detecting a presence in a space. In addition, the limit and/or threshold values for humidity, air pressure, $CO_2$ content, or a noise level in the surroundings can be determined, such that when they have been reached, certain actions are to be carried out by the application software. Likewise, it can also be determined by the application software that an image has been recorded by a camera module, if certain operating data or operating parameters (e.g. delivered by a presence sensor) exceed a threshold value or level.

A DALI interface, Bluetooth interface, LAN interface, PLC interface and/or USB interface can be provided in terms of hardware as the signaling interface S for communication. One or more microphones can likewise be provided. As stated above, the application software A can also determine how incoming signals are evaluated. Filters can thus be used (noise filters, echo filters, etc.) on the signals. Parameters and evaluations can be defined for the commissioning thereof, for certain application scenarios (e.g. a larger space with numerous cubicles), or situations. The size of the space in which an installation is to take place, or the number of lamps, can be also be defined, for example, which can then be selected or established. Test programs can also be executed by the application software A.

Various technologies and programming languages can be used as the programming platform for the application software A. By way of example, the application software can be created in JAVA, PYTHON, PEARL, C, C++, C#, RUBY, GO, . . . .

It should be understood that the ballast specified above represents converters, sensors, lamps, and other components of a lighting system. The technologies, designs and protocols listed for the interfaces are substantially interchangeable. The interfaces can be selectively exposed to the exterior, or covered. A cover for the respective interfaces that can be opened and closed selectively is also possible, as a matter of course.

Although the printed circuit board 1 is mainly described as a being disposed in the ballast, it should be understood that the printed circuit board 1 can also be disposed, alternatively or additionally, in other participants and components of a lighting system, e.g. the lighting system 8. The printed circuit board 1 can thus also be part of a sensor or actuator, for example.

An intelligent sensor IS is described below, which preferably comprises the printed circuit board 1, as described above. Consequently, the description of the ballast V and FIG. 1 also applies substantially to the intelligent sensor IS.

Figure 3:
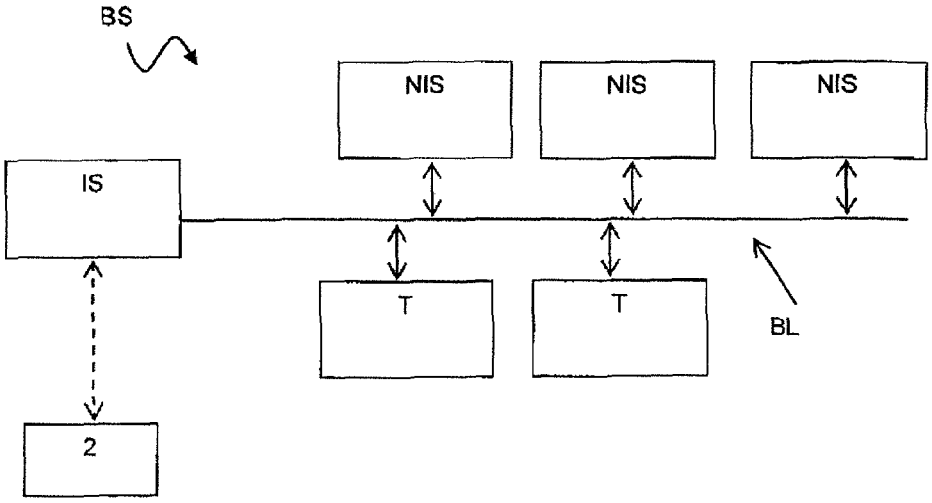
FIG. 3 shows a design of the invention.

An exemplary incorporation of the intelligent sensor IS in a lighting system BS is shown in FIG. 3. The intelligent sensor can be connected to the lighting system BS. The intelligent sensor IS can also be connected to a superordinate bus system (e.g. an IPv6 bus system, overlay network, . . . ), and have a microprocessor 2, a memory unit 3, and in particular an application software A. Furthermore, the intelligent sensor IS can communicate in a wire-connected or wireless manner with microprocessor 2 (broken-lined double arrow). The microprocessor 2 does not necessarily have to be part of the intelligent sensor IS. The intelligent sensor IS can read out and store data from numerous sensors NIS connected thereto, which are not intelligent sensors, i.e. not microprocessors memories, in a wire-connected manner via a bus line BL, or in a wireless manner. Data that have been read can be processed by the microprocessor 2. The lighting system BS can also have further intelligent sensors, and thus connect at least two sensors to one another. The bus line BL can form the signaling interface S.

The sensor IS preferably has a microprocessor 2, or is connected to a microprocessor 2. The sensor IS also has at least one memory unit 3, or is connected to a memory unit 3. Furthermore, there is a programming interface P that can preferably be accessed from outside the sensor IS, and at least one signaling interface S, which likewise is preferably accessible from outside the sensor IS. The microprocessor 2 can be configured via the programming interface P. At least one application software A that can be executed by the microprocessor 2 can be transmitted via the programming interface P to the at least one memory unit 3. The application software A has an effect on at least one of the following functions of the sensor IS:

I Interaction with other sensors NIS and components T, in particular ballasts V and the lighting system BS,
Evaluation of signals transmitted to the signaling interface,
Activation of one or more ballasts,
Activation/deactivation of interfaces of the sensor IS,
Activation/deactivation of communication protocols, and
Detection, adjustment, and/or evaluation of operating data and/or operating parameters of the sensor IS and/or the other sensors NIS,
Structure of a network,
Linking of networks.

The programming interface P and the signaling interface S can use the same hardware, and only be separate in terms of software.

The programming interface P and the signaling interface S can use the same hardware, and only be separate in terms of software.

The intelligent sensor IS can also define or assume functions and/or limit values for the non-intelligent sensors NIS or other intelligent sensors IS. The intelligent sensor IS can control or configure one or more ballasts or converters, depending on acquired data, e.g. from non-intelligent sensors NIS and/or its own data. The intelligent sensor IS can be an infrared camera. If a detection event is recorded by a non-intelligent sensor NIS, this sensor can send data to the intelligent sensor IS indicating that a detection even has been recorded. The application software A of the intelligent sensor IS can evaluate the transmitted data in an application-specific manner, and activate at least one other component T of the lighting system BS on the basis thereof, preferably a ballast or converter.

The intelligent sensor IS and/or the non-intelligent sensors NIS can also be integrated in one or more ballasts or converters.

What is claimed is:

1. A component of a lighting system comprising one of a ballast for LED lamps and a sensor, the component also comprising a microprocessor (2) with at least one memory unit (3), and a printed circuit board (1) with at least one programming interface (P), and at least one signaling interface (S) attached to it, wherein the microprocessor can be configured via the programming interface (P), and wherein at least one application software (A) that can be executed by the microprocessor (2) via the programming interface (P) can be transmitted to the at least one memory unit (3), wherein the application software (A) has an effect on at least one of the following functions of the component:

interaction with other additional sensors, evaluation of signals transmitted to the signaling interface (S),
activation of lamps,
activation/deactivation of interfaces of the component,
activation/deactivation of communication protocols, and
recording, adjustment and/or evaluation of operating data and/or operating parameters of the ballast (V),
structure of a network,
linking of networks; and wherein the programming interface (P) is blocked, and can be activated by inputting and/or transmitting a code.

2. The component according to claim 1, wherein the at least one application software (A) provides, makes available, and/or modifies an application programming interface.

3. The component according to claim 1 wherein the microprocessor executes a hardware abstraction layer, via which the at least one application software (A) accesses the programming interface (P) and/or the signaling interface (S).

4. The component according to claim 1 wherein the programming interface (P) is a wireless and/or wire-connected interface comprising a Bluetooth, WLAN, LAN, GPIO, Zigbee interface or a combination of these interfaces.

5. The component according to claim 1 wherein the signaling interface (S) serves to connect at least one signaling unit comprising one of, a switch, a button, a timer switch, a remote control, a presence sensor (5), a brightness sensor, a humidity sensor (6), a temperature sensor, and a microphone (5).

6. The component according to claim 1 wherein the signaling interface (S) is configured as a DALI, DSI, SPI, USB, $I^2C$ interface or a combination thereof.

7. The component according to claim 1 wherein the programming interface (P) and the signaling interface (S) use the same hardware, and are different only in terms of software.

8. The component according to claim 1 wherein the component is a ballast and the ballast (V) communicates with other ballasts and at least one converter (8) via at least one interface in a wireless manner over a bus wire-connected by radio transmission manner or combination thereof.

9. The component according to claim 1 wherein the application software (A) is configured to selectively block and/or enable a function provided by at least the programming interface (P), the signaling interface (S), and/or the application programming interface.

10. The component according to claim 1 wherein the at least one programming interface (P) is accessible from outside the component and the at least one signaling interface (S) is accessible from outside the component.

11. A component of a lighting system comprising one of a ballast for LED lamps and a sensor, the component also comprising a microprocessor (2) with at least one memory unit (3), and a printed circuit board (1) with at least one programming interface (P), and at least one signaling interface (S) attached to it, wherein the microprocessor can be configured via the programming interface (P), and wherein at least one application software (A) that can be executed by the microprocessor (2) via the programming interface (P) can be transmitted to the at least one memory unit (3), wherein the application software (A) has an effect on at least one of the following functions of the component:

interaction with other additional sensors, evaluation of signals transmitted to the signaling interface (S), activation of lamps, activation/deactivation of interfaces of the component, activation/deactivation of communication protocols, and recording, adjustment and/or evaluation of operating data and/or operating parameters of the ballast (V), structure of a network, linking of network; and wherein the programming interface (P) and the signaling interface (S) use the same hardware, and are different only in terms of software.

12. The component according to claim 11, wherein the at least one application software (A) provides, makes available, and/or modifies an application programming interface.

13. The component according to claim 11 wherein the microprocessor executes a hardware abstraction layer, via which the at least one application software (A) accesses the programming interface (P) and/or the signaling interface (S).

14. The component according to claim 11 wherein the programming interface (P) is a wireless and/or wire-connected interface comprising a Bluetooth, WLAN, LAN, GPIO, Zigbee interface or a combination of these interfaces.

15. The component according to claim 11 wherein the signaling interface (S) serves to connect at least one signaling unit comprising one of, a switch, a button, a timer switch, a remote control, a presence sensor (5), a brightness sensor, a humidity sensor (6), a temperature sensor, and a microphone (5).

16. The component according to claim 11 wherein the signaling interface (S) is configured as a DALI, DSI, SPI, USB, $I^2C$ interface or a combination thereof.

17. The component according to claim 11 wherein the programming interface (P) is blocked, and can be activated by inputting and/or transmitting a code.

18. The component according to claim 11 wherein the component is a ballast and the ballast (V) communicates with other ballasts and at least one converter (8) via at least one interface in a wireless manner over a bus wire-connected by radio transmission manner or combination thereof.

19. The component according to claim 11 wherein the application software (A) is configured to selectively block and/or enable a function provided by at least the programming interface (P), the signaling interface (S), and/or the application programming interface.

20. The component according to claim 11 wherein the component is a ballast and the at least one programming interface (P) is accessible from outside the ballast and the at least one signaling interface (S) is accessible from outside the ballast.

* * * * *